United States Patent [19]

Wiczer

[11] 4,035,942

[45] July 19, 1977

[54] BULLET IDENTIFICATION

[76] Inventor: Sol B. Wiczer, 1000 Vermont Ave., NW., Suite 804, Washington, D.C. 20005

[21] Appl. No.: 701,244

[22] Filed: June 30, 1976

[51] Int. Cl.[2] ..... F41C 27/00; F41C 21/00

[52] U.S. Cl. ..... 42/1 A; 42/1 R; 42/76 R

[58] Field of Search ..... 42/78, 76 R, 76 A, 1 R, 42/1 A

[56] References Cited

U.S. PATENT DOCUMENTS 3,562,945 2/1971 Mikola ..... 42/78

3,777,385 12/1973 Hagan ..... 42/78

*Primary Examiner*—Charles T. Jordan

[57] ABSTRACT

A system is provided for identifying a bullet with a gun from which it was fired wherein a marking die is supported in the barrel of a gun having cutting elements extending into the bore to impart groove-like markings upon a bullet surface when it is fired, the markings being arranged in groups of grooves, each group being readable in coded form as a digit portion of a number, the composite pattern of grooves upon the surface of the bullet forming a composite number corresponding to the registration number of the gun from which the bullet was fired.

10 Claims, 7 Drawing Figures

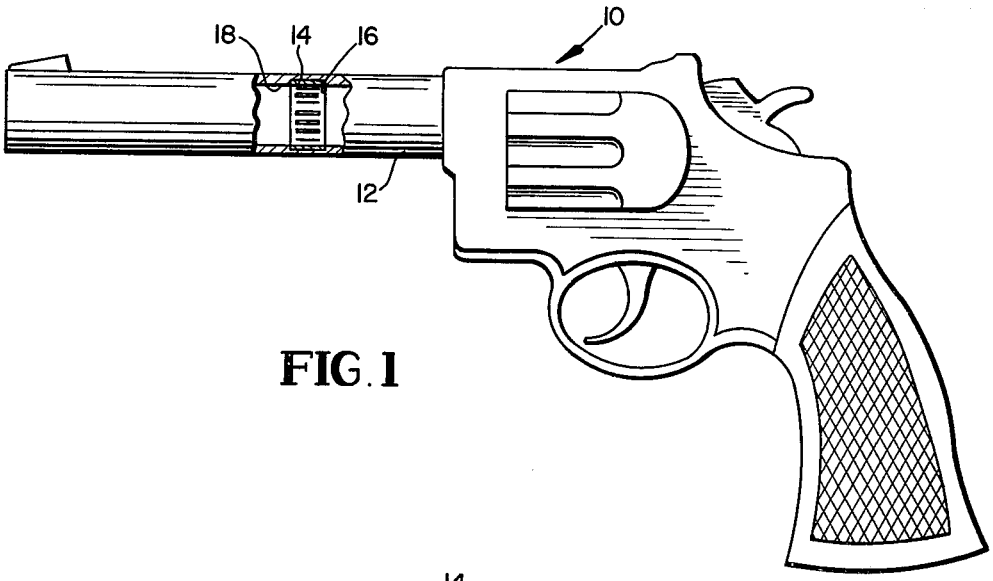
FIG. 1
FIG. 2
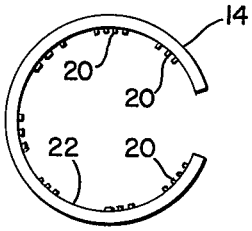
FIG. 3
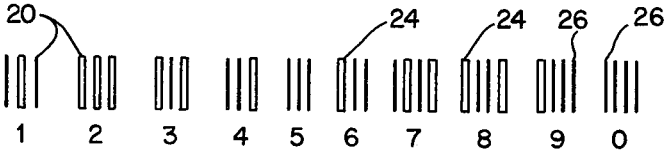
FIG. 4
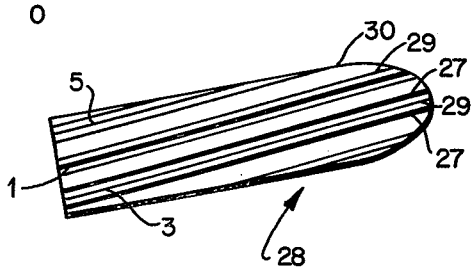
FIG. 7
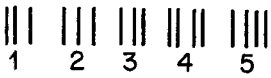
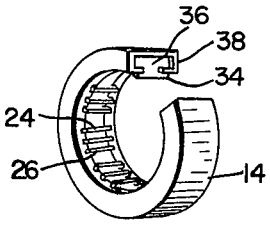
FIG. 5
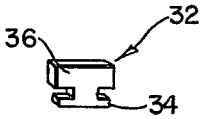
FIG. 6

BULLET IDENTIFICATION

This invention relates to a method and means for identifying a bullet with the gun or gun barrel from which it was fired, and more particularly to the mounting of a die in the barrel of a gun having selected marking elements supported for contact with the surface of a bullet being fired to impart regularly readable identifying markings thereon.

It is known in the art to examine a bullet, usually comparatively with another bullet, each with small irregular microscopically viewable markings imparted during firing to determine a similarity between such markings whereby to support a conclusion that both bullets were fired from the same gun.

According to the present invention a gun will have mounted in its barrel a die having bullet surface marking, such as cutting elements, positioned to allow physical marking contact with the surface of a bullet being fired, to impress upon its surface markings so arranged that they are readily readable upon examination of the fired bullet, to easily identify that bullet with the die and gun from which it was fired.

The markings may be arranged in a code whereby the combined markings may be easily read as a number, corresponding to a registration or identifying number of the gun. Thus, upon firing of a bullet from a gun having a die comprising cutting elements supported for contact with the surface of a bullet being fired, markings will be impressed upon the surface of the bullet readily readable to correspond with the identifying number of the gun used to fire that bullet.

Thus the present invention provides a quick and easy means for exactly identifying a bullet with a number identifiable gun from which that bullet was fired. The number may be a number on the gun applied by a manufacturer to each gun distributed in the regular course of wholesale disposal of the product, or it may be a number applied to the gun at the time of its registration, more practically the latter. In either case the die will be formed to reproduce on the bullet the selected identifying number of the gun from which it was fired.

The invention is further described in conjunction with the drawings herewith wherein:

FIG. 1 shows a gun, such as a pistol having a portion of the barrel cut open to show the mounting of a marking die therein;

FIG. 2 shows a circular spring-like die having marking elements upon its inner surface;

FIG. 3 illustrates a numbering code by which a readable number is formed from markings by a die;

FIG. 4 shows a bullet after firing having marking grooves cut in its surface readable as an identifying number for the bullet and gun from which it was fired;

FIG. 5 shows a marking die comprising a hollow ring into which selected marking elements may be assembled;

FIG. 6 illustrates a single marking element that may be assembled into a marking group as shown in FIG. 5; and FIG. 7 is an alternate code using similarly sized grooves combined as narrow and wide spacing combinations.

Referring to FIG. 1, a hand gun 10 is shown, but any type of small arm may be used according to this invention, including rapid firing, or machine guns. The gun 10 has a barrel 12 in which a circular ring die 14 such as shown in FIG. 2 is mounted and securely retained in a groove 16, correspondingly cut in a size to receive and retain the die ring 14.

The die ring 14 is a spring type in which, when both ends are pressed together, the diameter is reduced enough to allow the ring to slide in the gun bore 18 and when deposited in the groove 14, the ring will resiliently expand to fill the groove. That ring 14 in its spring-like expansion to the shape of FIG. 2 will be adequately retained under its normal spring bias in groove 16 in which it is dimensioned for close sliding fit, but it may be merely securely fastened therein as by welding or by locking means not shown, to resist easy removal or replacement.

The ring 14 has a series of die bars 20 mounted on or cut into the inner ring surface 22, disposed axially thereof. The die bars 20, as shown in FIG. 3, are formed as thick bars such bars 24 or thin die bars 26. Each of the bars extends radially inward from the ring surface 22 a distance sufficient to frictionally engage the surface of a bullet 28, as shown in FIG. 4, and cut corresponding longitudinal thick 27 or thin 29 grooves into the surface 30 of the bullet 28 as it passes rapidly on being fired through the ring 14 with its surface engaging or scraping against the radially extending die bars. Thus each thick or thin bar 27 or 29 cuts a corresponding thick or thin groove into the surface of the bullet as it fires and as its surface passes in frictional contact with the die bars. The bars are sized to extend radially sufficient to cut these grooves without significantly impeding the passage or speed of the bullet through the barrel.

The grooves 27 and 29 are readily seen or can be made light and shallow as only to be seen with a little magnification.

The thick and thin die bars 24 and 26 as shown in FIG. 3 can be regularly spaced, but in different combinations of two, three or four bars, so that each distinct combination can be designated to signify a number so that each distinct combination of thick and thin bars comprises a coded form of a number. Thus in FIG. 3 two thin bars spearated by a thick bar can represent the numberal 1. Three thick bars are shown to represent the numeral 2 etc, so that as shown all ten digits are representable in distinct combinations of thick and thin bars. These several combinations are arbitrarilly assigned each to represent a numeral which can be as shown or other combinations can be used for this purpose following the same principle, and preferably set as a standard code, universally readable similar to a "morse" code. Obviously, a similar grouping of grooves, readable in condensations of grooves can be used to designate numbers where each groove is the same as others, but they distinguish in groups where some grooves are close spaced to designate narrow grooves and other are wider spaced to designate bars, and each different combination close spaced and wide space can correspondingly designate a numeral in the selected combination. Such alternative is shown in FIG. 7.

Each group of die bars can be assembled on a single die 32, as shown in FIG. 6 and thus provide a combination of bars 24 or 26 thereon as shown in FIGS. 3 or 7 to form a selected number. Then when an overall number is to be reproduced, the several digits to be cut by assembling die elements 32 in the proper order to cut the ultimate combination of digits forming the final identifying number. For this purpose the selected die elements 32, formed with cutting bars extending from one surface 34 and having a grouping collar 36 is assembled into the channel 38 of a hollow channeled ring 14 into which the collar 36 of the die element 32 can be slided and retained thereon. The several die elements 32 can be assembled into the ring 14 to form the overall die, as shown in FIG. 5. In this assembled form each ring 14 of assembled dies 32 will have its cutting bars 24 or 26 protruding radially inward of the ring 14 in position to cut the selected grooves into the surface of a bullet 28 as shown for the ring 14 in FIG. 5 in the form on the bullet 28 as shown in FIG. 4.

In this way easy examination of a bullet 28 after firing will identify a number cut thereon according to the combination of grooves supplied by the ring die in the barrel of the gun from which it was fired, readable according to a number designation code as illustrated in FIGS. 3 or 7.

The die element may be formed of small metal stampings or cuttings from metal such as machinable iron, which then may be case hardened after cutting the die markings thereon. Again, the marking lines can be formed of harder materials molded to a marking line or ridge such as from tiny crystals of tungsten carbide or molybdenum carbide distributed in a matrix of a binder metal such as soft iron as known in the art for making such hard metal cutting tools. Moreover, the die elements as mounted and held in a ring can have the metallic ring sealed into the gun barrel irremovably, as by welding, and polishing the weld so that the ring itself is firmly imbedded in the bore of the gun with only the die marking ridges extending above the barrel bore surface, thus positioned to impart by cutting the markings into the surface of the bullet passed thereby in firing. In this manner, marking elements including the marking ring in which they were originally assembled is irremovably mounted in the gun bore. Other ways of securing the marking elements into the gun bore for imparting markings upon the bullet may be substituted.

I claim:

1. A system for identifying a bullet with a gun having a barrel bore through which the bullet was fired comprising mounting marking elements in said barrrel bore capable of imparting markings upon the bullet surface as it passes said elements in surface contact therewith, said marking elements being arranged to apply markings to the bullet surface as identifying insignia visibly readable on said surface to identify said bullet with corresponding identifying indicia upon the gun from which said bullet was fired.

2. The system as defined in claim 1 wherein the markings imparted to said bullet upon being fired are readable in coded form as a number corresponding to a number on said gun by which said gun is identifiable.

3. The system as defined in claim 2 wherein the markings are a series of grooves cut in the bullet surface in passing during firing through said bore in contact with said marking elements, said grooves consisting of wide grooves and narrow grooves arranged in a pattern formed of groups of grooves in said bullet surface and readable as a code, each group being readable in a code representative of a digit with the total pattern of said groups of grooves being readable as a number corresponding both to said digits and to the number applied to said gun for identification of the gun from which said bullet was fired.

4. The system as defined in claim 2 wherein the markings are a series of grooves cut in the bullet surface in passing during firing through said bore in contact with said marking elements, said grooves consisting of groups of grooves, each groove having the same width and depth as others, but spaced into groups of grooves separated from each other upon the bullet surface, each group having the grooves thereof varied in spacing one groove from the next and in number of grooves, whereby a group of grooves will be readable as a code to signify a digit corresponding to each group, the composite of all of the groups being significant of a number corresponding both to said digits and to number applied to said gun for identification of the gun from which said bullet was fired.

5. The system as defined in claim 1 wherein said marking elements comprise projecting ridge of metal cutting substance hard enough to cut a groove into the surface of a bullet passing through the bore of said gun, said marking elements being combined in groups as a marking die mounted in the bore of said gun with said marking elements extending from the bore surface into contact with the surface of a bullet passing through said bore during firing to cut groove-like markings into the bullet surface.

6. The marking die as defined in claim 5 wherein the marking elements are shaped and spaced to form a pattern of grooves upon the surface of a bullet fired from said gun, said pattern of grooves being formed of groups of grooves in said bullet surface and readable as a code, each group being readable in a code representative of a digit, with the total pattern of said groups of grooves being readable as a number corresponding both to said digits and to the number applied to said gun for identification of the gun from which said bullet was fired.

7. The marking die as defined in claim 5 wherein the marking elements are shaped and spaced to form a pattern of grooves upon the surface of a bullet fired from said gun, said grooves consisting of groups of grooves, each groove having the same width and depth as others, but spaced into groups of grooves separated from each other upon the bullet surface, each group having the grooves thereof varied in spacing one groove from the next and in number of grooves, whereby a group of grooves will be readable as a code to signify a digit corresponding to each group, the composite of all the groups being significant of a number corresponding both to said digits and to the number applied to said gun for identification of the gun from which said bullet was fired.

8. The system as defined in claim 1 wherein said marking elements are disposed to extend into the bore of said gun from marking contact with a surface of a bullet fired therefrom, said marking elements being substantially irremovably fixed in the surface of said gun bore.

9. The system as defined in claim 1 wherein said gun has a radial groove cut in the bore thereof, said groove being sized in length and depth to receive a spring:like ring resiliently insertable in said groove, said ring having marking elements disposed therein and supported as a marking die with groove-cutting elements extending from the surface of the bore of said gun into marking contact to cut a pattern of identifying grooves into the surface of a bullet fired from said gun.

10. The method of identifying a bullet with a gun having a bore through which the bullet was fired, comprising mounting a marking die in said bore of the gun to be identified, said die having marking elements positioned to impart markings on the surface of said bullet when it is fired, said markings imparted to said bullet being arranged in a coded pattern physically readable as a number corresponding to the pattern of said markings, said number corresponding to the number of the gun assigned in registration of said gun.

* * * * *